US009004140B2

(12) United States Patent
Hailes

(10) Patent No.: US 9,004,140 B2
(45) Date of Patent: Apr. 14, 2015

(54) BATTEN ASSEMBLY FOR ROMAN BLIND

(75) Inventor: Donald C. Hailes, Seaford (AU)

(73) Assignee: SPP Industries Holdings Pty Ltd, Colmslie Queensland (AU)

( * ) Notice: Subject to any disclaimer, the term of this patent is extended or adjusted under 35 U.S.C. 154(b) by 934 days.

(21) Appl. No.: 12/303,730

(22) PCT Filed: Jun. 6, 2007

(86) PCT No.: PCT/AU2007/000789

§ 371 (c)(1),
(2), (4) Date: May 2, 2011

(87) PCT Pub. No.: WO2007/140526

PCT Pub. Date: Dec. 13, 2007

(65) Prior Publication Data

US 2011/0203080 A1 Aug. 25, 2011

(30) Foreign Application Priority Data

Jun. 6, 2006 (AU) ..... 2006903061

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***A47H 7/00*** | (2006.01) |
| ***E06B 9/262*** | (2006.01) |

(52) U.S. Cl.
CPC ..... *E06B 9/262* (2013.01); *E06B 2009/2622* (2013.01)

(58) Field of Classification Search
USPC ..... 160/84.01, 84.04, 264
See application file for complete search history.

(56) References Cited

U.S. PATENT DOCUMENTS

| | | | | |
|---|---|---|---|---|
| 4,637,178 | A * | 1/1987 | Nimmo et al. | 52/36.4 |
| 6,257,300 | B1 | 7/2001 | Brownlie | |
| 6,854,500 | B2 * | 2/2005 | Chen et al. | 160/84.01 |
| 7,124,801 | B2 * | 10/2006 | Ng et al. | 160/84.04 |
| 7,124,802 | B2 * | 10/2006 | Sudano | 160/89 |
| 2001/0005002 | A1 | 6/2001 | Berman et al. | |
| 2004/0231805 | A1 | 11/2004 | Sudano | |
| 2005/0224188 | A1 | 10/2005 | Nien | |

FOREIGN PATENT DOCUMENTS

| | | |
|---|---|---|
| WO | 01/22853 | 4/2001 |
| WO | 2005/044064 | 5/2005 |

OTHER PUBLICATIONS

International Search Report for corresponding application No. PCT/AU2007/00789 dated Jun. 19, 2007.

* cited by examiner

*Primary Examiner* — Katherine Mitchell
*Assistant Examiner* — Jeremy Ramsey
(74) *Attorney, Agent, or Firm* — Renner, Otto, Boisselle & Sklar, LLP

(57) ABSTRACT

A hollow body batten having sidewalls (2) joined by a transverse wall (4) which divides the hollow body into a fabric cavity (6) and a clip cavity (8). Access to the clip cavity (8) is through a clip slot (10) which extends from end to end of the batten. Access to the fabric cavity (6) is through a fabric slot (12) which extends from end to end of the batten.

13 Claims, 2 Drawing Sheets

BATTEN ASSEMBLY FOR ROMAN BLIND

This application is a national phase of International Application No. PCT/AU2007/000789 filed Jun. 6, 2007 and published in the English language.

FIELD OF THE INVENTION

This invention concerns batten assemblies for Roman blinds.

BACKGROUND OF THE INVENTION

Roman blinds are raised and lowered by allowing them to form orderly folds or loops. Loop formation is assisted by battens which have a series of eyes through which vertical suspensory lines run and it is the lines which control the binding and release of the loops.

In U.S. Pat. No. 6,257,300 a known assembly comprises a fold forming steel batten having a hollow almost circular body which defines a fabric slot running from end to end. A rod lies inside the body and traps a fold of fabric inside the body. A projecting spine on the batten body terminates in a bead. Bifurcated clips are snapped onto the bead. Each clip has an eye for the blind line.

In another known batten assembly disclosed in WO2005/044064, the same rear circular hollow batten is used with a rod to imprison a fold of fabric in the batten interior but the clips profile matches that of the near circular batten. The clips are made of resilient metal in order to snap over the body. Each clip has an eye for the blind line.

SUMMARY OF THE INVENTION

The apparatus aspect of the invention provides a batten assembly for a Roman blind having (a) an elongate hollow body with a pair of axial, mutually opposite slots; a transverse wall extending from end to end dividing the body into a clip cavity with a clip slot and a fabric cavity with a fabric slot; the fabric cavity being capable of accommodating and retaining a fold of fabric, the clip cavity being capable of admitting and retaining a clip for guiding a control line, (b) at least two clips for guiding control lines, each clip having a part which is insertable into the clip cavity through one of the axial slots and securable by partial rotation.

The batten body may have converging walls which render the width of both slots less than the width of the transverse wall. The walls may instead be parallel with inturned flanges, but the purpose of both versions is to render the walls deformable so as to grip the inserted fabric and prevent its removal from the cavity.

The ends of the fabric slot may be closed by a stop. Preferably the stop closes the ends of both slots. Moulded end caps make convenient stops.

The batten may be an extrusion of lightweight material such as plastic or aluminium. Metal is preferred because any deformation required is easy to impose.

The clip may have an eye for the reception of a guide control line. The clip may have a reaction surface which is urged against the body on both sides of the fabric slot when the insertable part of the clip is inserted into the slot and rotated.

The insertable part may be a stem with a cam surface capable of engaging with the edges of the body which define the clip slot.

The eye of the clip may be generally planar and the cam surface may be a pair of shoulders at 90° to the plane of the eye. To the assembly therefore the plane of the eyes of both clips is common and parallel to the axis of the batten body.

It is convenient to manufacture the batten stock as an aluminum or plastic extrusion with a continuous fabric cavity and a continuous clip cavity. Only the fabric cavity need be continuous from end to end so that fabric may be inserted over its entire length during the blind building stages. The clip cavity is continuous but the clip slot giving access to the clip cavity need not be. The clip slots may be incised in the cavity at the two sites where the control lines will intersect the batten. These may be 15-30 mm long which is sufficient to introduce a clip.

BRIEF DESCRIPTION OF THE DRAWINGS

One embodiment of the invention is now described with reference to the accompanying drawings, in which.

DETAILED DESCRIPTION WITH RESPECT TO THE DRAWINGS

Figure 1:
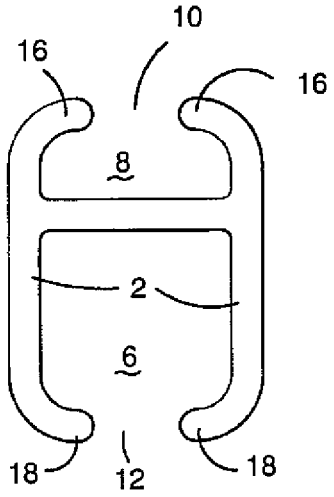
FIG. 1 is an end section of the batten.

Referring now to the drawings, the hollow body of the batten is an aluminium extrusion bout 5 m in length which is docked into batten lengths, up to 3000 mm long. The batten is 10 mm deep and 8 mm wide. Sidewalls 2 are joined by transverse wall 4 which divides the hollow body into a fabric cavity 6 and a clip cavity 8.

Access to the clip cavity is through a clip slot 10 which extends from end to end.

Access to the fabric cavity is through a fabric slot 12 which extends from end to end of the body. Both ends are closed by moulded end caps 14 (see FIG. 5). The ends 16, 18 of the sidewalls are inturned in order to make the slots 3 mm wide, whereas the cavities are 6 mm wide.

Figure 2:
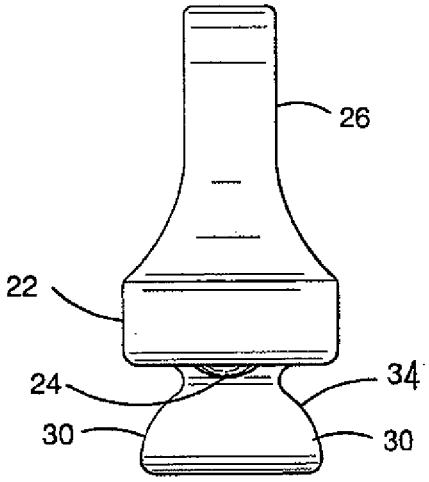
FIG. 2 is an end view of a clip.
Figure 3:
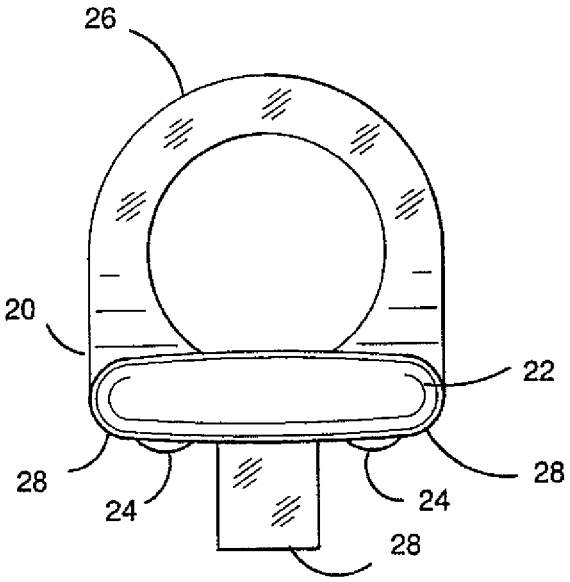
FIG. 3 is a side view of the clip.
Figure 4:
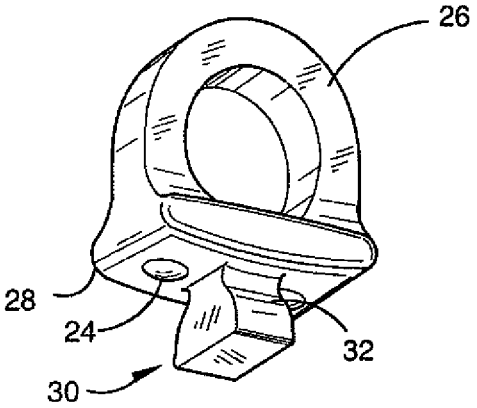
FIG. 4 is a perspective of the clip.

FIGS. 2-4 show the construction of the clip 20. The clip is a unitary moulding in polycarbonate. The rectangular base 22 (11 mm×7 mm) has a slight convexity on its undersurface. A pair of domes 24 project from the undersurface to rest in the slot 10 after insertion. Its top surface has an integral upstanding eye 26. The eye acts as a finger grip for the clip.

The ends 28 of the base are rounded and the central part of the undersurface has a downwardly projecting leg 30. Feet 32 project at 90° to the plane of the eye 26. The leg is 3 mm wide and is insertable into the clip slot. A reaction surface (s-shaped cam surface) 34 on each foot engages the curved ends of the side walls and draws the convex underface of the base tightly against the body on each side of the clip slot. Once rotated through 90° the clip remains in position on the batten until reversed and slid to a new position. Thus the spacing between the clips remains at whatever spacing the installer selects.

This spacing will conform to the spacing of the control line pulleys (not shown) at the head of the Roman blind for which the battens are intended.

Figure 5:
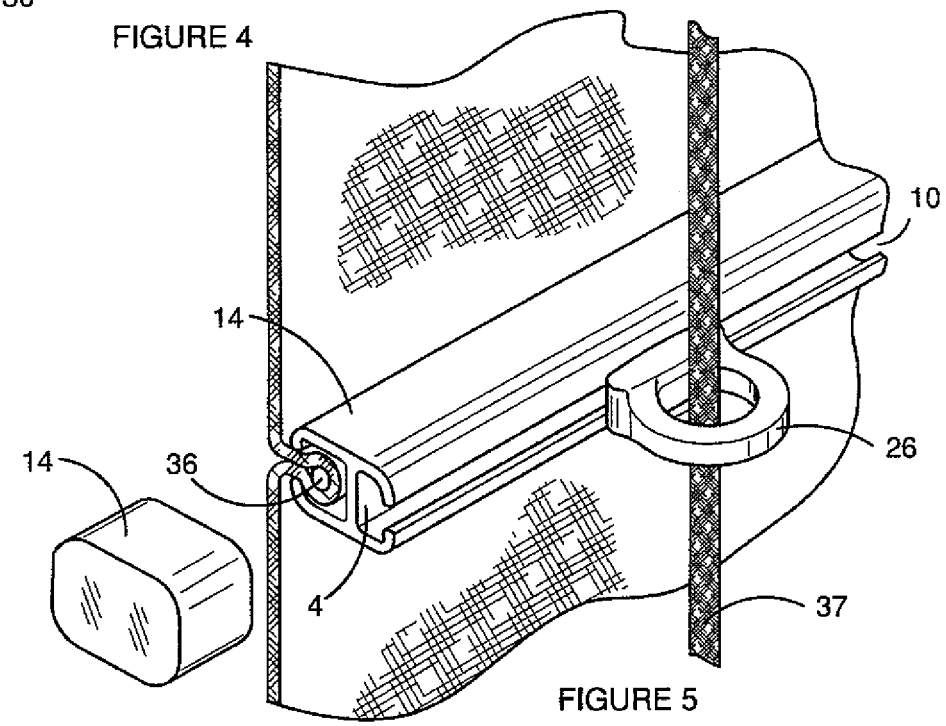
FIG. 5 is a fragment of a blind showing part of a batten in position.

FIG. 5 shows how the fabric is folded as if to form a seam and slid into the cavity from one open end. Nylon rod 36 imprisons the fabric fold in the fabric cavity. Optionally the batten can then be dropped into a grooved die and a presser beam is forced down upon the transverse wall to keep open the clip slot while tending to close the fabric slot. The clips are inserted at the correct spacings and rotated to lock them in position. The lines 37 are threaded through the aligned pairs of clips.

Figure 6:
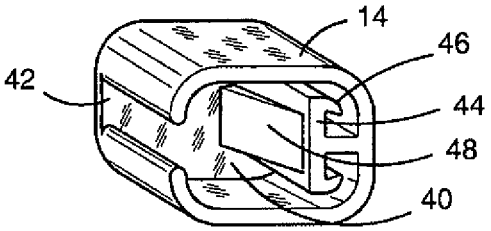
FIG. 6 is a perspective of an end cap for the batten in FIG. 5.

The addition of an end cap 14 to both ends of each batten improves the appearance. In FIG. 6 the cap moulding has an end wall 40 and corresponds in section to the profile of the batten. Cap slot 42 corresponds with and overlies fabric slot 12. Opposite the cap slot 42 is a T-section projection 44 extending into the interior of the cap. The longitudinal edges 46 of the projection mimic the curvature of the edges 16 of the batten. A ramp face 48 ensures that the projection contacts the transverse wall 4.

In my co-pending Application No. 2006904526 I describe a moulded cap with a keyhole slot which fits onto the end of a batten to facilitate the introduction of the fabric and rod into the fabric cavity. These disclosures are intended to be read as related documents.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A Roman blind batten assembly comprising:

(a) an elongate hollow body comprising a transverse wall having an axial length extending from end to end dividing the body into a clip cavity having the same axial length with a clip slot and a fabric cavity having the same axial length with a fabric slot; the clip slot and the fabric slot being a pair of axial, mutually opposite slots; the fabric cavity being capable of accommodating and retaining a fold of fabric, the clip cavity being capable of admitting and retaining at least two clips for guiding respective control lines, and (b) said at least two clips for guiding respective control lines, each clip having an insertable part which is insertable into the clip cavity through the clip slot, each insertable part being configured to engage with internal walls along the axial length of the clip cavity by partial rotation of the insertable part within the clip cavity so as to secure the clip relative to the clip cavity, and each insertable part being configured to disengage with internal walls of the clip cavity by partial rotation of the insertable part within the clip cavity so as to release the clip for slidably repositioning at any axial length within the clip cavity.

2. A batten assembly as claimed in claim 1, wherein the batten body has converging walls which render the width of both slots less than the width of the transverse wall.

3. A batten assembly as claimed in claim 1, wherein the batten body has mutually parallel walls with inturned edges for contacting the fabric and preventing its removal from the cavity.

4. A batten assembly as claimed in claim 2, wherein the axial slot for the clips extends from end to end.

5. A batten assembly as claimed in claim 1, wherein the ends of the slots are closed by end caps.

6. A batten assembly as claimed in claim 1, wherein the clip has an eye for the reception of a guide control line.

7. A batten assembly as claimed in claim 6, wherein the clip has a reaction surface which in use is urged against the body on both sides of the fabric clip slot when the insertable part of the clip is inserted into the slot and rotated.

8. A batten assembly as claimed in claim 7, wherein the insertable part is a stem with a cam surface capable of engaging with the edges of the body which defines the clip slot.

9. A batten assembly as claimed in claim 8, wherein the eye of the clip is planar along a plane and the cam surface comprises a pair of shoulders at 90° to the plane of the eye.

10. A batten assembly as claimed in claim 9, wherein the plane of the eyes of a pair of clips is common and parallel to a longitudinal axis of the elongate hollow body.

11. A Roman blind batten assembly comprising:

(a) an elongate hollow body having an axial length; a transverse wall extending from end to end dividing the body into a clip cavity having the same axial length with a clip slot and a fabric cavity having the same axial length with a fabric slot; the clip slot and the fabric slot being a pair of axial, mutually opposite slots; the fabric cavity being capable of accommodating and retaining a fold of fabric, the clip cavity being capable of admitting and retaining at least two clips for guiding respective control lines, and (b) said at least two clips for guiding control lines, each clip having an insertable part, the insertable part having a substantially rectangular face for facing the transverse wall when inserted into the clip cavity and a pair of shoulders extending from the substantially rectangular face for engaging with internal walls along the axial length of the clip cavity, the insertable part being insertable into the clip cavity through one of the axial slots, each clip being securable relative to the body by partial rotation of the insertable part within the clip cavity such that the pair of shoulders are brought into engagement with the walls of the clip cavity, and each clip being releasable by partial rotation of the insertable part within the clip cavity for slidably repositioning at any axial length relative to the body such that the pair of shoulders are disengaged from the walls of the clip cavity.

12. A batten assembly as claimed in claim 11, wherein each insertable part is configured to engage and disengage with the internal walls of the clip cavity by a 90° rotation of the insertable part within the clip cavity.

13. A batten assembly as claimed in claim 1, wherein each insertable part is configured to engage and disengage with the internal walls of the clip cavity by a 90° rotation of the insertable part within the clip cavity.

* * * * *